US011192396B2

(12) United States Patent
Takada et al.

(10) Patent No.: US 11,192,396 B2
(45) Date of Patent: Dec. 7, 2021

(54) TRANSFER TYPE INK JET RECORDING APPARATUS AND TRANSFER TYPE INK JET RECORDING METHOD

(71) Applicant: CANON KABUSHIKI KAISHA, Tokyo (JP)

(72) Inventors: Yoichi Takada, Yokohama (JP); Koji Inoue, Tokyo (JP); Toru Ohnishi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 97 days.

(21) Appl. No.: 16/712,062

(22) Filed: Dec. 12, 2019

(65) Prior Publication Data

US 2020/0114675 A1 Apr. 16, 2020

Related U.S. Application Data

(63) Continuation of application No. PCT/JP2018/022422, filed on Jun. 12, 2018.

(30) Foreign Application Priority Data

Jun. 19, 2017 (JP) ..... JP2017-119877

(51) Int. Cl.
*B41J 2/005* (2006.01)
*B41M 7/00* (2006.01)

(52) U.S. Cl.
CPC ..... *B41M 7/0018* (2013.01)

(58) Field of Classification Search
CPC .... B41M 7/00; B41M 7/0018; B41M 5/0017; B41J 2/0057
See application file for complete search history.

(56) References Cited

U.S. PATENT DOCUMENTS 3,962,153 A 6/1976 Gore
4,920,361 A 4/1990 Urahara et al.
(Continued)

FOREIGN PATENT DOCUMENTS

JP S56-045773 B2 10/1981
JP 2001-088276 A 4/2001
(Continued)

OTHER PUBLICATIONS

Mori, MachineTranslationofJP-2005170036-A, 2005 (Year: 2005).*
(Continued)

*Primary Examiner* — Scott A Richmond
(74) *Attorney, Agent, or Firm* — Venable LLP

(57) ABSTRACT

There is provided a transfer type ink jet recording apparatus including: an image forming section forming an image by applying, onto a transfer body, a reaction liquid for increasing a viscosity of ink and ink containing an aqueous liquid medium and a coloring material; a liquid absorbing section having a porous body that absorbs at least a part of a liquid component from the formed image; a heating section heating the image treated by the porous body; a transfer section that transfers the heated image onto a recording medium; and a deterioration prevention treatment section including a deterioration preventing agent applying device that applies, onto the porous body provided in the liquid absorbing section, a deterioration preventing agent that prevents deterioration of the transfer body.

21 Claims, 6 Drawing Sheets

(56) References Cited

U.S. PATENT DOCUMENTS

| | | | |
|---|---|---|---|
| 5,004,928 | A | 4/1991 | Suzuki et al. |
| 5,084,758 | A | 1/1992 | Danzuka et al. |
| 5,383,734 | A | 1/1995 | Uchikata et al. |
| 5,541,626 | A | 7/1996 | Hiramatsu et al. |
| 5,596,353 | A | 1/1997 | Takada et al. |
| 5,736,996 | A | 4/1998 | Takada et al. |
| 5,790,143 | A | 8/1998 | Takada et al. |
| 5,923,350 | A | 7/1999 | Ohnishi et al. |
| 6,076,923 | A | 6/2000 | Kashimura et al. |
| 6,116,728 | A | 9/2000 | Miyake et al. |
| 6,151,040 | A | 11/2000 | Takada et al. |
| 6,354,015 | B1 | 3/2002 | Ogasawara et al. |
| 6,398,358 | B1 | 6/2002 | Miyake et al. |
| 6,543,892 | B2 | 4/2003 | Kubota et al. |
| 6,655,772 | B2 | 12/2003 | Danzuka et al. |
| 6,749,290 | B2 | 6/2004 | Takada et al. |
| 7,281,790 | B2 | 10/2007 | Mouri et al. |
| 8,226,192 | B2 | 7/2012 | Inoue et al. |
| 9,102,137 | B2 | 8/2015 | Koitabashi et al. |
| 10,046,556 | B2 | 8/2018 | Soma et al. |
| 10,239,330 | B2 | 3/2019 | Ohnishi et al. |
| 10,384,474 | B2 | 8/2019 | Hirokawa et al. |
| 10,457,076 | B2 | 10/2019 | Inoue et al. |
| 10,513,119 | B2 | 12/2019 | Inoue et al. |
| 10,543,679 | B2 | 1/2020 | Masuda et al. |
| 10,549,526 | B2 | 2/2020 | Inoue et al. |
| 10,556,448 | B2 | 2/2020 | Ohnishi et al. |
| 10,569,580 | B2 | 2/2020 | Deguchi et al. |
| 2005/0110856 | A1 | 5/2005 | Mouri et al. |
| 2008/0006176 | A1 | 1/2008 | Houjou |
| 2016/0083609 | A1 | 3/2016 | Sisler et al. |
| 2017/0130087 | A1 | 5/2017 | Sisler et al. |
| 2017/0217211 | A1* | 8/2017 | Nakano ..... B41J 11/002 |
| 2018/0304615 | A1 | 10/2018 | Soma et al. |
| 2018/0311951 | A1 | 11/2018 | Sakamoto et al. |
| 2019/0009549 | A1 | 1/2019 | Takada et al. |
| 2019/0009578 | A1 | 1/2019 | Takeuchi et al. |
| 2019/0009592 | A1 | 1/2019 | Okushima et al. |

FOREIGN PATENT DOCUMENTS

| | | | | |
|---|---|---|---|---|
| JP | 2001088276 | A | * | 4/2001 |
| JP | 2005-170036 | A | | 6/2005 |
| JP | 2005170036 | A | * | 6/2005 ..... B41M 5/0017 |
| JP | 2008-019286 | A | | 1/2008 |
| JP | 2015-044351 | A | | 3/2015 |
| JP | 2015044351 | A | * | 3/2015 |
| JP | 2015-202617 | A | | 11/2015 |

OTHER PUBLICATIONS

Seo, MachineTranslationofJP-2015044351-A, 2015 (Year: 2015).*

Ogasawara, MachineTranslationofJP-2001088276-A, 2001 (Year: 2001).*

Jul. 17, 2018 International Search Report in International Patent Appln. No. PCT/JP2018/022422.

Dec. 24, 2019 International Preliminary Reporton Patentability in International Patent Appln. No. PCT/JP2018/022422.

Jun. 15, 2021 Japanese Official Action in Japanese Patent Appln. No. 2017-119877.

* cited by examiner

TRANSFER TYPE INK JET RECORDING APPARATUS AND TRANSFER TYPE INK JET RECORDING METHOD

CROSS-REFERENCE TO RELATED APPLICATIONS

This application is a Continuation of International Patent Application No. PCT/JP2018/022422, filed Jun. 12, 2018, which claims the benefit of Japanese Patent Application No. 2017-119877, filed Jun. 19, 2017, both of which are hereby incorporated by reference herein in their entirety.

BACKGROUND OF THE INVENTION

Field of the Invention

The present invention relates to a transfer type ink jet recording apparatus and a transfer type ink jet recording method.

Description of the Related Art

In the transfer type ink jet recording apparatus, a liquid component can be removed from an intermediate image on a transfer body, such that feathering does not occur in an image obtained after the intermediate image is transferred onto a recording medium such as paper. In addition, since the image from which the liquid component is removed is transferred from the transfer body onto the recording medium, an occurrence of curling or cockling on the recording medium onto which the image is transferred can be prevented.

On the other hand, in the transfer type ink jet recording apparatus, bleeding that ink adjacently applied onto the transfer body is mixed or beading that the previously landed ink is attracted to the ink landed later may occur in some cases. In contrast, a technology for applying a reaction liquid (referred to as a treatment liquid) for increasing a viscosity of ink by agglomerating a solid content, such as a coloring material, in the ink, and suppressing bleeding or beading by suppressing an interference between ink dots, prior to applying the ink, has been known. In a case of using a method of forming an intermediate image using a reaction liquid and ink, a total amount of liquid component applied onto a transfer body tends to be increased.

In Japanese Patent Application Laid-Open No. 2008-19286, as means for removing a liquid component contained in an image on a transfer body, a method of absorbing and removing the liquid component from ink on the transfer body by using a porous body as a liquid absorbing member without using thermal energy is disclosed. In addition, in Japanese Patent Application Laid-Open No. 2015-202617, a method in which an image on a transfer body and a recording medium are irradiated with infrared rays and a transfer is performed in a state in which a temperature of the recording medium is higher than that of the image is disclosed. By doing so, an adhesion force between the image and the recording medium becomes greater than an adhesion force between the transfer body and the image, good transfer body can thus be performed.

In the transfer type ink jet recording, in order to improve a removal efficiency of the liquid component from the image having a large amount of applied liquid component and formed on the transfer body using the reaction liquid and the ink, it is effective to add a heating treatment of the image in addition to an absorption treatment of the liquid component by a liquid absorbing member having a porous body. In addition, by increasing a set temperature in the heating treatment, the removal efficiency of the liquid component can be further improved and it is possible to cope with high-speed image formation.

However, under a temperature condition in the heating treatment of the image formed using the reaction liquid containing an acid and the ink, durability of the transfer body is likely to be degraded due to deterioration of the transfer body repeatedly used. An object of the present invention is to provide a transfer type ink jet recording apparatus and a transfer type ink jet recording method that can prevent deterioration of a transfer body by a heating treatment of an image formed on the transfer body using a reaction liquid containing an acid, and ink.

SUMMARY OF THE INVENTION

A transfer type ink jet recording apparatus including:

an image forming section including an image forming unit that applies, onto a transfer body, a reaction liquid containing an acid for increasing a viscosity of ink and ink containing an aqueous liquid medium and a coloring material to form a first image containing an aqueous liquid component and the coloring material;

a liquid absorbing section including a liquid absorbing member having a porous body that comes into contact with the first image and absorbs at least a part of the liquid component from the first image to form a second image;

a heating section including a heating device that heats the second image;

a transfer section that transfers the second image heated by the heating section onto a recording medium; and a deterioration prevention treatment section including a deterioration preventing agent applying device that applies, onto the porous body, a deterioration preventing agent that prevents deterioration of the transfer body.

Further features of the present invention will become apparent from the following description of exemplary embodiments with reference to the attached drawings.

DESCRIPTION OF THE EMBODIMENTS

Figure 1:
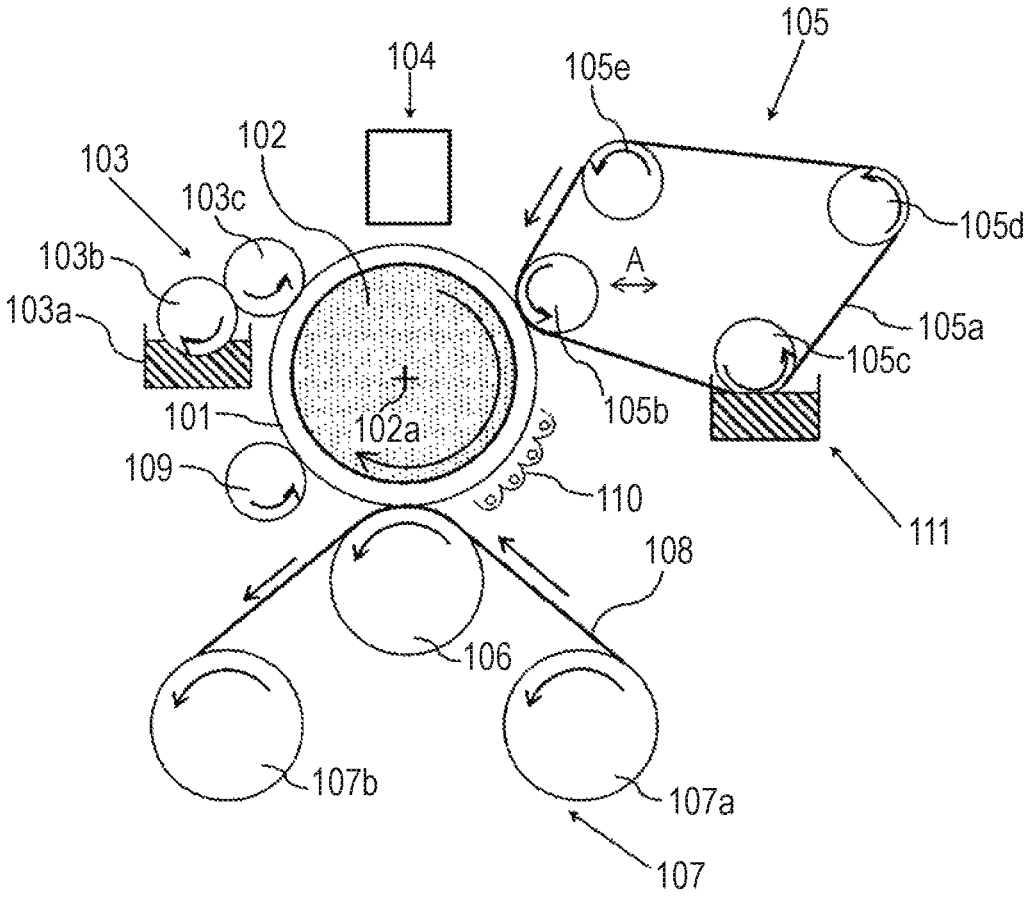
FIG. 1 is a schematic view illustrating an example of a configuration of a transfer type ink jet recording apparatus in the present invention.

In general, in a transfer type ink jet recording apparatus in which a reaction liquid for increasing a viscosity of ink, and ink are used in image formation, since the amount of liquid component contained in an image formed on a transfer body becomes large, the removal of the liquid component on the transfer body from the image is an important technical challenge.

In a case where the amount of liquid component contained in the image is large, it is effective to perform both a heating treatment under a high temperature condition and a liquid absorption treatment by a liquid absorbing member of a porous body as described in Japanese Patent Application Laid-Open No. 2008-19286. By additionally performing such a heating treatment, it is possible to provide a liquid removal effect capable of coping with high-speed image formation.

On the other hand, in a case where a resin component that forms a film by softening or melting by heating is added to at least one of the reaction liquid or the ink, a difference between a film forming temperature by the resin component and a temperature of the image after transfer becomes large, such that it is possible to further improve the image fastness. Even in this case, performing of both the liquid absorption treatment by the porous body and the heating treatment under a high temperature condition is effective means.

For example, in a case where an image is formed on a transfer body onto which a reaction liquid is applied in advance using ink containing a resin emulsion, a transfer is performed by performing the liquid absorption treatment on the image on the transfer body and then performing heating at a minimum filming temperature (MFT) or higher of the resin emulsion. Japanese Patent Application Laid-Open No. 2008-19286 discloses that the transfer can be performed at a low temperature by using a resin emulsion having a low MFT. However, there is a concern that fastness of the image obtained by using the resin emulsion having the low MFT deteriorates. According to studies conducted by the inventors of the present invention, it is preferable that MFT is 100° C. or higher in order to improve the image fastness. In this case, in order to achieve both transferability and image fastness, it is required to set the heating temperature during the transfer to 100° C. or higher. However, it was found that when the heating temperature is increased to secure the transferability or improve the image fastness, in a case where the reaction liquid containing an acid is used, a chemical reaction of the acid contained in the reaction liquid with the transfer body is generated, the transfer body deteriorates, and the durability may thus be degraded. This is considered as a reaction between the acid unreacted with the ink and a material on a surface of the transfer body. It was also found that deterioration is likely to occur in a region in which the ink is not applied and a large amount of unreacted acid remains.

As a result of intensive studies on the deterioration of the transfer body, the inventors of the present invention newly found that a deterioration preventing agent is applied onto a transfer body using a liquid absorbing member, such that the deterioration of the transfer body is efficiently prevented, thereby achieving good durability in repeated use. The present invention is completed based on the new findings by the inventors of the present invention.

The transfer type ink jet recording apparatus according to the present invention includes the following sections.

(A) An image forming section including an image forming unit that applies, onto a transfer body, a reaction liquid containing an acid for increasing a viscosity of ink and ink containing an aqueous liquid medium and a coloring material to form a first image containing an aqueous liquid component and the coloring material.

(B) A liquid absorbing section including a liquid absorbing member having a porous body that comes into contact with the first image and absorbs at least a part of the liquid component from the first image to form a second image.

(C) A deterioration prevention treatment section including a deterioration preventing agent applying device that applies, onto the porous body, a deterioration preventing agent that prevents deterioration of the transfer body.

(D) A heating section including a heating device that heats the second image.

(E) A transfer section that transfers the second image heated by the heating section onto a recording medium.

The transfer type ink jet recording method according to the present invention includes the following steps.

(1) An image forming step of applying, onto a transfer body, a reaction liquid containing an acid for increasing a viscosity of ink and ink containing an aqueous liquid medium and a coloring material to form a first image containing an aqueous liquid component and the coloring material.

(2) A liquid absorbing step of bringing a porous body of a liquid absorbing member into contact with the first image and absorbing at least a part of the liquid component from the first image to form a second image.

(3) A deterioration preventing agent applying step of applying, onto the porous body, a deterioration preventing agent that prevents deterioration of the transfer body.

(4) A heating step of heating the second image.

(5) A transfer step of transferring the second image heated in the heating step onto a recording medium.

In the present invention, the deterioration preventing agent that prevents deterioration of the transfer body is applied onto the transfer body through the porous body of the liquid absorbing member. By using a method of applying a deterioration preventing agent, it is possible to efficiently apply the deterioration preventing agent onto the transfer body and to improve the durability in repeated use of the transfer body. Further, since the liquid absorbing member has also a function of applying the deterioration preventing agent onto the transfer body, it is unnecessary to separately dispose a deterioration preventing agent applying device around the transfer body, such that a compact apparatus can be achieved.

It is preferable that the respective steps described above are performed by providing a conveyance device to move the transfer body relative to the image forming section, the liquid absorbing section, the heating section, and the transfer section. As described later, in a configuration in which the transfer body is disposed on a circumferential surface of a support member having a cylindrical shape, the conveyance device includes a support member and a rotation drive device for the support member and rotates the support member, such that it is possible to move the transfer body relative to the respective sections.

Hereinafter, the present invention is described in detail with reference to preferred embodiments.

Image Forming Unit

The image forming unit is not particularly limited as long as it can form a first image containing an aqueous liquid component and a coloring material on a transfer body. The first image is referred to as an "ink image before liquid removal" before being subjected to a liquid absorption treatment by the liquid absorbing member. In addition, an "ink image after liquid removal" in which a content of the aqueous liquid component is decreased by performing a liquid absorption treatment is referred to as a second image.

The image forming unit preferably includes a device including a reaction liquid applying unit that applies a reaction liquid onto the transfer body, and a device including an ink applying unit that applies ink containing an aqueous liquid medium and a coloring material onto the transfer body.

The first image as a liquid absorption treatment target is formed by applying the reaction liquid and the ink onto the transfer body so that the reaction liquid and the ink have at least a region in which they are overlapped with each other. The fixability of the coloring material applied onto the transfer body together with the ink is promoted and improved by the reaction liquid. The promotion and improvement of the fixability of the coloring material refer to a fixed state in which the fluidity of the ink itself or the coloring material in the ink is reduced by the action of the reaction liquid, and the ink is unlikely to flow due to the increased viscosity thereof as compared with an initial state in which the ink applied onto the transfer body has fluidity. The mechanism will be described later.

The first image is formed in a state of including a mixture of the reaction liquid and the ink. The ink contains an aqueous liquid medium containing water, and the reaction liquid also contains an aqueous liquid medium containing water as necessary. The aqueous liquid medium contains at least water and contains an aqueous organic solvent or various types of additives as necessary. The first image contains an aqueous liquid component containing water supplied from these aqueous liquid media together with the coloring material.

In at least one of the reaction liquid or the ink, a second liquid other than water can be contained when water is contained as a first liquid. Although the second liquid may have a high or low volatility, the second liquid preferably has a volatility higher than that of the first liquid.

Reaction Liquid Applying Device

A reaction liquid applying device may be any device capable of applying a reaction liquid onto a transfer body, and conventionally known various devices can be adequately used. Specifically, examples of the reaction liquid applying device include a gravure offset roller, an ink jet head, a die coating device (die coater), and a blade coating device (blade coater). When the reaction liquid can be mixed (reacted) with the ink on the transfer body, the application of the reaction liquid by the reaction liquid applying device may be performed before the application of the ink or after the application of the ink. Preferably, the reaction liquid is applied before the application of the ink. By applying the reaction liquid before the application of the ink, an occurrence of bleeding that ink adjacently applied is mixed or beading that the previously landed ink is attracted to the ink landed later can be suppressed during the image formation by an ink jet method.

Reaction Liquid

The reaction liquid contains a component (ink viscosity-increasing component) for increasing a viscosity of ink. The increasing of the viscosity of ink means that a coloring material or a resin which is a part of components contained in the ink comes into contact with an ink viscosity-increasing component, resulting in chemical reaction or physical adsorption, whereby an increase in viscosity of ink is recognized. The case of increasing the viscosity of ink includes not only a case where an ink viscosity increase is recognized, but also a case where a part of the component contained in the ink, such as a coloring material or a resin, is condensed, thereby locally increasing the viscosity of ink. As a method of condensing the part of the component included in the ink, a reaction liquid that reduces the dispersion stability of a pigment in the ink can be used. The ink viscosity-increasing component has an effect of reducing the fluidity of the ink and/or the part of the component included in the ink on the transfer body and of suppressing bleeding and beading during formation of the first image. The increasing of the viscosity of ink also refers to as "viscously thickening of ink". As such an ink viscosity-increasing component, a known viscosity-increasing component, for example, an acid such as an organic acid can be used.

In the present embodiment, at least an acid is used as the ink viscosity-increasing component. It is preferable that a plurality of types of ink viscosity-increasing components are contained. In addition, it is preferable that a content of the ink viscosity-increasing component in the reaction liquid is 5% by mass or more with respect to the total mass of the reaction liquid.

The acid as the viscosity-increasing component is preferably an organic acid. Examples of the organic acid include oxalic acid, polyacrylic acid, formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidone carboxylic acid, piron carboxylic acid, pyrrole carboxylic acid, furan carboxylic acid, pyridine carboxylic acid, coumarin acid, thiophene carboxylic acid, nicotinic acid, oxysuccinic acid, and dioxysuccinic acid. The reaction liquid can contain an adequate amount of water or organic solvent with a low volatility as the aqueous liquid medium. Water to be used in this case is preferably deionized water obtained by ion exchange. In addition, an organic solvent that can be used for the reaction liquid is not particularly limited, and a known organic solvent can be used.

In addition, the reaction liquid can be used by adding a surfactant or a viscosity modifier and adequately adjusting a surface tension and a viscosity thereof. A material to be used is not particularly limited as long as it can coexist with the ink viscosity-increasing component. Specifically, examples of the surfactant to be used include fluorochemical surfactants such as an acetylene glycol ethylene oxide adduct (product name: Acetylenol E100, manufactured by Kawaken Fine Chemicals Co., Ltd.), and a perfluoroalkyl ethylene oxide adduct (product name: Megafac F444, manufactured by DIC Corporation).

Ink Applying Device

An ink jet device can be used as an ink applying device that applies ink. Examples of an ink ejecting form of an ink jet head in the ink jet device include the following forms.

- A form of ejecting ink by causing film boiling in the ink to form air bubbles by an electrothermal conversion body
- A form of ejecting ink by an electromechanical conversion body
- A form of ejecting ink by using static electricity In the present embodiment, a known ink jet head can be used. Among them, particularly, an ink jet head using an electrothermal conversion body is preferably used from the viewpoint of performing printing at a high speed and a high density. Drawing is performed by receiving an image signal and applying a necessary amount of ink to each position.

Although the amount of applied ink can be represented by an image density (duty) or an ink thickness, in the present embodiment, the amount of applied ink ($g/m^2$) is given by an average value obtained by dividing the product of the mass of each ink dot and the number of applications (the number of ejections) by a printing area. It should be noted that a maximum amount of ink applied to an image region represents the amount of ink applied to an area of at least 5 $mm^2$ in a region used as information on a body to be recorded from the viewpoint of removing the liquid content in the ink.

The ink jet device may have a plurality of ink jet heads in order to apply ink of each color onto the transfer body. For example, in a case where each color image is formed using yellow ink, magenta ink, cyan ink, and black ink, the ink jet recording apparatus includes four ink jet heads that eject the respective four types of ink onto the body to be recorded.

In addition, the ink applying device may include an ink jet head that ejects ink (clear ink) containing no coloring material.

The respective components of the ink in the present embodiment will be described below.

Coloring Material

A pigment or a mixture of a dye and a pigment can be used as a coloring material contained in the ink. The type of pigment that can be used as a coloring material is not particularly limited. Specific examples of the pigment include inorganic pigments such as carbon black; and organic pigments such as azo-based, phthalocyanine-based, quinacridone-based, isoindolinone-based, imidazolone-based, diketopyrrolopyrrole-based, and dioxazine-based pigments. One or two or more types of pigments can be used as necessary.

The type of dye that can be used as a coloring material is not particularly limited. Specific examples of the dye include a direct dye, an acid dye, a basic dye, a disperse dye, and an edible dye, and a dye having an anionic group can be used. Specific examples of a dye skeleton include an azo skeleton, a triphenylmethane skeleton, a phthalocyanine skeleton, an azaphthalocyanine skeleton, a xanthene skeleton, and an anthrapyridone skeleton.

A content of the pigment in the ink is preferably 0.5% by mass or more and 15.0% by mass or less and more preferably 1.0% by mass or more and 10.0% by mass or less with respect to the total mass of the ink.

Dispersant

Known dispersants used in the ink for ink jet can be used as a dispersant for dispersing the pigment. Among them, in the present embodiment, a water-soluble dispersant having both a hydrophilic moiety and a water-repellent moiety in a structure is preferably used. In particular, a pigment dispersant formed of a copolymerized resin including at least a hydrophilic monomer and a water-repellent monomer is preferably used. Here, each monomer to be used is not particularly limited and a known monomer is preferably used. Specifically, examples of the water-repellent monomer include styrene, other styrene derivatives, alkyl (meth)acrylate, and benzyl (meth)acrylate. In addition, examples of the hydrophilic monomer include acrylic acid, methacrylic acid, and maleic acid.

An acid value of the dispersant is preferably 50 mgKOH/g or more and 550 mgKOH/g or less. In addition, a weight average molecular weight of the dispersant is preferably 1000 or more and 50000 or less. A mass ratio (pigment: dispersant) of the pigment to the dispersant is preferably in a range of 1:0.1 to 1:3. In addition, it is preferable to use a so-called self-dispersible pigment capable of being dispersed itself by surface-modification without using a dispersant.

Resin Fine Particles

Ink containing various fine particles having no coloring material can be used. Among them, resin fine particles that are effective in improving the image quality or fixability are preferable.

A material of the resin fine particle that can be used in the present invention is not particularly limited and a known resin can be adequately used. Specifically, an example of the material of the resin fine particle includes a homopolymer, such as polyolefin, polystyrene, polyurethane, polyester, polyether, polyurea, polyamide, polyvinyl alcohol, poly (meth)acrylate and a salt thereof, alkyl poly(meth)acrylate, and polydiene; or a copolymer polymerized by combining a plurality of monomers for generating these homopolymers. A weight average molecular weight (Mw) of the resin is preferably in a range of 1,000 or more and 2,000,000 or less. In addition, the amount of resin fine particles in the ink is preferably 1% by mass or more and 50% by mass or less and more preferably 2% by mass or more and 40% by mass or less with respect to the total amount of the ink.

It is preferable that a resin fine particle dispersion in which the resin fine particles are dispersed in a liquid is used in the preparation of the ink. A dispersion method is not particularly limited, and a so-called self-dispersible resin fine particle dispersion dispersed using a resin obtained by homopolymerization of a monomer having a dissociable group or by copolymerization of a plurality of monomers is preferable. In this case, examples of the dissociable group include a carboxyl group, a sulfonic acid group, and a phosphoric acid group, and examples of the monomer having a dissociable group include acrylic acid and methacrylic acid. In addition, similarly, a so-called emulsion dispersed resin fine particle dispersion in which resin fine particles are dispersed by an emulsifier can also be preferably used in the present invention. As the emulsifier described above, a known surfactant is preferably used regardless of whether a molecular weight thereof is low or high. The surfactant is preferably a nonionic surfactant or a surfactant having the same charge as that of the resin fine particles.

A dispersion particle diameter of the resin fine particle dispersion is preferably 10 nm or more and 1000 nm or less, more preferably 50 nm or more and 500 nm or less, and still more preferably 100 nm or more and 500 nm or less. In addition, when the resin fine particle dispersion is produced, in order to stabilize the dispersion, various types of additives are preferably added thereto. Examples of the additives include n-hexadecane, dodecyl methacrylate, stearyl methacrylate, chlorobenzene, dodecyl mercaptan, a blue dye (bluing agent), and a polymethyl methacrylate.

It is preferable to use a resin fine particle including a resin component capable of further accelerating the film formation with the second image by softening or melting by heating in a state of being contained in the second image. In addition, in order to improve the image fastness, it is preferable to use a resin fine particle formed of a resin having a glass transition temperature (Tg) of 30° C. or higher.

Surfactant

The ink that can be used in the present invention may contain a surfactant. A specific example of the surfactant includes an acetylene glycol ethylene oxide adduct (product name: Acetylenol E100, manufactured by Kawaken Fine Chemicals Co., Ltd.). The amount of surfactant in the ink is preferably 0.01% by mass or more and 5.0% by mass or less with respect to the total mass of the ink.

Water and Aqueous Organic Solvent

Aqueous ink containing an aqueous liquid medium and a coloring material is used as the ink. Aqueous pigment ink containing at least a pigment as a coloring material can be used as the aqueous ink.

The aqueous liquid medium contains at least water and can further contain an aqueous organic solvent as necessary. The water is preferably deionized water obtained by ion exchange. In addition, a content of water in the ink is preferably 30% by mass or more and 97% by mass or less with respect to the total mass of the ink.

The type of aqueous organic solvent is not particularly limited, and any known aqueous organic solvent can be used. Specific examples of the aqueous organic solvent include glycerin, diethylene glycol, polyethylene glycol, polypropylene glycol, ethylene glycol, propylene glycol, butylene glycol, triethylene glycol, thiodiglycol, hexylene glycol, ethylene glycol monomethyl ether, diethylene glycol monomethyl ether, 2-pyrrolidone, ethanol, and methanol. At least two solvents selected from these aqueous organic solvents can also be used by mixing them. In addition, a content of the aqueous organic solvent in the ink is preferably 3% by mass or more and 70% by mass or less with respect to the total mass of the ink.

Other Additives

The ink may contain various additives such as a pH adjuster, a rust preventive, a preservative, a mildew-proofing agent, an antioxidant, an anti-reducing agent, a water-soluble resin and a neutralizing agent thereof, and a viscosity adjuster, in addition to the above components, as necessary.

Liquid Absorbing Member

In the present embodiment, at least a part of the aqueous liquid component is absorbed from the first image by bringing the liquid absorbing member having the porous body into contact with the first image, such that a content of the liquid component in the first image is reduced. A surface of the liquid absorbing member coming into contact with the first image is defined as a first surface, and the porous body is disposed on the first surface.

Porous Body

It is preferable that a porous body has a small pore diameter in order to suppress the adhesion of the coloring material of the ink, and a pore diameter of the porous body positioned on a side into contact with at least the first image (first surface) is preferably 1 μm or less. In the present invention, the pore diameter represents an average diameter, and can be measured by known means, for example, a mercury intrusion method, a nitrogen adsorption method, or a scanning electron microscope (SEM) image observation.

In addition, the porous body preferably has a small thickness in order to achieve uniformly high air permeability. The air permeability can be represented by Gurley value defined by JIS P8117. The Gurley value is preferably 10 seconds or less. A shape of the porous body is not particularly limited and examples thereof include a roller shape and a belt shape.

However, a thin porous body may not sufficiently secure a necessary capacity for absorbing the liquid component. Therefore, the porous body can have a multilayered structure. In addition, in the liquid absorbing member, a layer that comes into contact with the image on the transfer body may have the porous body, and a layer that does not come into contact with the image on the transfer body may not have the porous body. In addition, a production method of the porous body is not particularly limited, and a method broadly used in the related art can be applied. As an example, a production method of a porous body obtained by biaxial stretching a resin containing polytetrafluoroethylene described in Japanese Patent No. 1114482 may be used. In the present invention, a material for forming a porous body is not particularly limited, and it is possible to use both a hydrophilic material having an angle of contact with water of less than 90° and a water-repellent material having an angle of contact with water of 90° or greater.

In the case of the hydrophilic material, the angle of contact with water is more preferably 40° or less. When a first layer is formed of a hydrophilic material, the first layer provides an effect of sucking up an aqueous liquid component, particularly water, by a capillary force.

Examples of the hydrophilic material include polyolefin (such as polyethylene (PE)), polyurethane, nylon, polyamide, polyester (such as polyethylene terephthalate (PET)), and polysulfone (PSF).

The porous body preferably has water repellency to reduce the affinity with the coloring material contained in the first image. A water-repellent porous body preferably has an angle of contact with pure water of 90° or greater. As a result of intensive studies by the inventors of the present invention, it was found that adhesion of the coloring material of the ink to the porous body can be suppressed by using a porous body having an angle of contact with pure water of 90° or greater. The angle of contact herein is an angle formed between a surface of an object and the tangent of a liquid drop at a portion where a measurement liquid is added dropwise to the object and the liquid drop comes into contact with the object. Although some types of techniques for measurement are provided, the inventors of the present invention measured the water repellency in accordance with the technique described in "6. Sessile drop method" in JIS R3257.

In addition, although the material of the water-repellent porous body is not particularly limited as long as it has an angle of contact with pure water of 90° or greater, the material is preferably formed of a water-repellent resin. In addition, the water-repellent resin is preferably a fluororesin. Specific examples of the fluororesin include polytetrafluoroethylene (PTFE), polychlorotrifluoroethylene (PCTFE), polyvinylidene fluoride (PVDF), polyvinyl fluoride (PVF), perfluoroalkoxy-fluororesin (PFA), tetrafluoroethylene-hexafluoropropylene copolymer (FEP), ethylene-tetrafluoroethylene copolymer (ETFE), and ethylene-chlorotrifluoroethylene copolymer (ECTFE). One or two or more types of resins may be used as necessary, and a structure in which a plurality of films are laminated may be adopted. Among them, polytetrafluoroethylene is preferable.

Multilayered Structure

Next, an embodiment when the porous body has a multilayered structure will be described. Here, a description is given by assuming that a layer on a side into contact with the first image is a first layer, and a layer laminated on the surface opposite to the contact surface of the first layer with the first image is a second layer. Furthermore, the multilayered structure is sequentially expressed in order of lamination from the first layer. Herein, the first layer may be referred to as an "absorption layer", and the second and subsequent layer may be referred to as a "support layer".

First Layer

The first layer can be formed of the porous body previously described in the section of "(Porous Body)".

In order to suppress adhesion of the coloring material and enhance a cleaning performance, the water-repellent porous body described above is preferably used as the first layer. One or two or more types of resins may be used as necessary, and a structure in which a plurality of films are laminated in the first layer may be adopted. In the present invention, a thickness of the first layer is preferably 50 μm or less. The thickness of the first layer is more preferably 30 μm or less. In Examples of the present invention, the thickness of the first layer was obtained by measuring the thicknesses at 10 arbitrary points by a rectilinear micrometer OMV_25 (manufactured by Mitutoyo Corporation), and then calculating the average value of the measured thicknesses.

The first layer can be produced by a known method of producing a thin porous film. For example, after a sheet-shaped resin material is obtained by a method such as an extrusion molding, the first layer can be obtained by stretching the sheet-shaped resin material to a predetermined thickness. In addition, a porous film can be obtained by adding a plasticizer such as paraffin to the material during extrusion molding and removing the plasticizer by heating or the like during stretching. The pore diameter can be adjusted by adequately adjusting the amount of added plasticizer and a stretch ratio.

Second Layer

The second layer is preferably a layer having air permeability. Such a layer may be either non-woven fabric or woven fabric of resin fiber. Although a material of the second layer is not particularly limited, in order to prevent the liquid absorbed by the first layer from flowing backward, a contact angle of a material with the aqueous liquid component absorbed from the image is preferably equal to or lower than that of the first layer. Specifically, the material of the second layer is preferably selected from a single material such as polyolefin (such as polyethylene (PE) and polypropylene (PP)), polyurethane, nylon, polyamide, polyester (such as polyethylene terephthalate (PET)), and polysulfone (PSF), or a composite material thereof. In addition, the second layer is preferably a layer having a pore diameter larger than that of the first layer.

Third Layer

The porous body having a multilayered structure may have three or more layers. The third or subsequent layer (referred to as the third layer) is preferably formed of non-woven fabric from the viewpoint of rigidity. As the material, the same material as that of the second layer is used.

Other Materials

The liquid absorbing member may have a reinforcement member reinforcing a side surface of the liquid absorbing member, in addition to the porous body in the laminate structure. In addition, the liquid absorbing member may have a joining member when a belt-shaped member is formed by connecting the longitudinal ends of an elongated sheet-shaped porous body. A non-porous tape material can be used as such a material, and the material may be disposed at a position or an interval where the material does not come into contact with an image.

Method of Producing Porous Body

A method of forming the porous body by laminating the first layer and the second layer is not particularly limited. The layers may be only superposed on each other or the layers may be bonded to each other using a method such as lamination by an adhesive or lamination by heating. In the present invention, from the viewpoint of the air permeability, the lamination by heating is preferable. Further, for example, a portion of the first layer or the second layer may be melted by heating and then bonded and laminated. Alternatively, a fusing material such as hot melt powder may be interposed between the first layer and the second layer to bond and laminate the first layer and the second layer by heating. When the third and subsequent layers are laminated, the layers may be laminated at a time or may be sequentially laminated, and the order of lamination may be appropriately selected.

In a heating step, it is preferable to use the lamination method in which the porous body is heated while the porous body is nipped and pressurized by heated rollers.

Pretreatment

A deterioration preventing agent applying step is performed as a pretreatment before the porous body of the liquid absorbing member comes into contact with the first image. In the deterioration preventing agent applying step, a deterioration preventing agent that prevents deterioration of the transfer body is applied onto the porous body using a deterioration preventing agent applying device 111. As the deterioration preventing agent, a liquid deterioration preventing agent (deterioration preventing liquid) is preferable. As the deterioration preventing agent, any deterioration preventing agent may be used as long as it can be applied through the porous body of the liquid absorbing member and can provide a deterioration preventing effect by reducing or eliminating the reactivity of the acid with the transfer body. As the deterioration preventing agent, it is preferable to use a liquid having a deterioration preventing function by neutralizing the reaction liquid containing an acid, or by shifting a pH of the reaction liquid from the acidic side to the vicinity of the neutral and further from the neutral to the alkaline side. Examples of such a liquid include water, an alkaline solution such as an aqueous sodium hydroxide solution, and a neutral or alkaline buffer solution.

By applying the deterioration preventing agent onto the porous body of the liquid absorbing member, the deterioration preventing agent is applied to the reaction liquid on the transfer body when pressing, by the porous body, a portion where the ink of the transfer body is not applied and the unreacted reaction liquid remains. Although the reaction liquid is absorbed by the porous body by the action of the liquid absorption by the pressed porous body, it is considered that the deterioration preventing agent applied onto the porous body and the reaction liquid come into contact with each other and are slightly mixed on an interface between the pressed porous body and the reaction liquid remaining on the transfer body. Therefore, it is considered that the acid component moves to the porous body from the reaction liquid, meanwhile, the component of the deterioration preventing agent moves to the reaction liquid remaining on the transfer body, and as a result, the acid of the reaction liquid remaining on the transfer body is decreased, and the deterioration preventing agent is incorporated in the reaction liquid instead of the acid. As such, the deterioration preventing agent applied onto the transfer body acts on the reaction liquid and the deterioration of the transfer body can thus be prevented. In the case of the deterioration preventing agent including the neutral or alkaline buffer solution, a pH of the reaction liquid can approach the neutral side. As a result, it is assumed that the deterioration of the transfer body can be prevented even in a case where the heating condition of high temperature in the heating treatment of the second image is selected, and the degradation of the durability of the transfer body is suppressed.

The deterioration preventing agent is more preferably an alkaline buffer solution. The deterioration preventing effect of the transfer body becomes more remarkable by the alkaline buffer solution.

In addition, the deterioration preventing agent preferably contains water and an aqueous organic solvent. The water is preferably deionized water obtained by ion exchange. Further, the type of aqueous organic solvent is not particularly limited, and any known organic solvent such as ethanol or isopropyl alcohol can be used. In the pretreatment by applying the deterioration preventing agent to the liquid absorbing member, a method of applying a deterioration preventing agent is not particularly limited, and immersion or liquid droplet dropping is preferable.

Next, specific examples of embodiments of the ink jet recording apparatus according to the present invention will be described.

Transfer Type Ink Jet Recording Apparatus

FIG. 1 is a schematic view illustrating an example of a configuration of a transfer type ink jet recording apparatus of the present invention.

The apparatus includes a transfer body 101, a reaction liquid applying device 103 that applies a reaction liquid, an ink applying device 104 that applies ink to form a first image on the transfer body, a liquid absorbing device 105, a heating device 110, and a pressing member 106 for transfer.

The transfer type ink jet recording apparatus may further include a transfer body cleaning member 109 that cleans a surface of the transfer body 101 after a second image is transferred onto a recording medium 108.

A support member 102 rotates about a rotation axis 102*a* in a direction of arrow A of FIG. 1. The transfer body 101 is moved by the rotation of the support member 102. A conveyance device of the transfer body that includes the support member 102 and a rotation drive device for the support member 102 (not illustrated) is provided in the illustrated apparatus.

The reaction liquid of the reaction liquid applying device 103 and the ink of the ink applying device 104 are sequentially applied onto the moved transfer body 101 to form a first image on the transfer body 101 as an ink image before the liquid absorption. The first image formed on the transfer body 101 is moved to a position where the first image comes into contact with a liquid absorbing member 105*a* of the liquid absorbing device 105 by the movement of the transfer body 101.

The liquid absorbing member 105*a* of the liquid absorbing device 105 is moved in synchronization with the rotation of the transfer body 101. The first image formed on the transfer body 101 undergoes a state of coming in contact with the moving liquid absorbing member 105*a*. During this time, the liquid absorbing member 105*a* removes the liquid component including at least an aqueous liquid component from the first image. The liquid component contained in the first image is removed through the state of coming into contact with the liquid absorbing member 105*a*. In the contact state, it is preferable that the liquid absorbing member 105*a* is pressed against the first image with a predetermined pressing force in terms of allowing the liquid absorbing member 105*a* to effectively function.

From a different point of view, the removal of the liquid component can be expressed as condensing the ink forming the image formed on the transfer body. The condensing of the ink means that a proportion of a solid content contained in the ink, such as a coloring material and a resin, to the liquid component is increased by the reduction of the liquid component contained in the ink.

Then, the second image which is an ink image after the liquid absorption after the liquid component is removed from the first image, is moved to a transfer section coming into contact with the recording medium conveyed by a recording medium conveyance device 107, by the movement of the transfer body 101. While the second image after the liquid component is removed comes into contact with the recording medium 108, the pressing member 106 for transfer presses the recording medium 108, such that the image (ink image) is transferred onto the recording medium. The ink image transferred onto the recording medium 108 after the transfer is a reverse image of the second image.

Since the image is formed by applying the reaction liquid onto the transfer body and then applying the ink, the reaction liquid remains without reacting with the ink in a non-image region (non-ink image formation region) in which the image is not formed by the ink. In the apparatus, the liquid absorbing member 105*a* removes the liquid component not only from the image but also removes the liquid component of the reaction liquid from the surface of the transfer body 101 by coming into contact with the unreacted reaction liquid. Therefore, hereinabove, although it is expressed and described that the liquid component is removed from the image, it is not limitedly indicated that the liquid component is removed only from the image, and means that the liquid component may be removed from at least the image on the transfer body. For example, it is also possible to remove the liquid component in the reaction liquid applied to the outer side region of the first image together with the first image. The liquid component does not have a certain shape and has fluidity. The shape of the liquid component is not particularly limited as long as it has approximately an almost constant volume. For example, water, an organic solvent, or the like contained in the ink or the reaction liquid is exemplified as the liquid component.

In addition, even in a case where the clear ink described above is contained in the first image, the ink can be condensed by the liquid absorption treatment. For example, in a case where the clear ink is applied to color ink containing the coloring material which is applied onto the transfer body 101, the clear ink is present over the entire surface of the first image or the clear ink is partially present at one portion or a plurality of portions of the surface of the first image, and the color ink is present at the other portions. In the first image, the porous body absorbs the liquid component of the clear ink on the surface of the first image at the portion where the clear ink is present on the color ink, and the liquid component of the clear ink is moved. Accordingly, the liquid component in the color ink is moved to the porous body, such that the liquid component in the color ink is absorbed. Meanwhile, at the portion where the region of the clear ink and the region of the color ink are present on the surface of the first image, the respective liquid components of the color ink and the clear ink are moved to the porous body, and thus the liquid component is absorbed. The clear ink may contain a large amount of component for improving transferability of the image from the transfer body 101 onto the recording medium. For example, a case where a content of the component in the clear ink is increased so that adhesiveness of the clear ink to the recording medium is increased by heating compared to the color ink is exemplified.

An example of each component of the transfer type ink jet recording apparatus of the present invention will be described below.

Transfer Body

The transfer body 101 includes a surface layer including an image formation surface. Various materials such as a resin and ceramic can be adequately used as a material of the surface layer, and a material having a high compression elastic modulus is preferable in terms of durability of the transfer body. Specific examples of the material include an acrylic resin, an acryl silicone resin, a fluorine contained resin, and a condensate obtained by condensing a hydrolyzable organic silicon compound. In order to improve wettability, transferability, and the like of the reaction liquid, a surface treatment may be performed. Examples of the surface treatment include a frame treatment, a corona treatment, a plasma treatment, a polishing treatment, a roughening treatment, an active energy ray irradiation treatment, an ozone treatment, a surfactant treatment, and a silane coupling treatment. A plurality of treatments may be used in combination. In addition, the surface layer can be formed in any surface shape. In addition, the transfer body preferably includes a compressive layer having a function of absorbing a pressure fluctuation. By disposing the compressive layer, the compressive layer can absorb the deformation, disperse local pressure fluctuations, and thus maintain good transferability even at the time of high-speed printing. Examples of a material of the compressive layer include acrylonitrile-butadiene rubber, acryl rubber, chloroprene rubber, urethane rubber, and silicone rubber. At the time of molding the rubber material, it is preferable that a predetermined amount of a vulcanizing agent, a vulcanization accelerator, or the like is blended, and a foaming agent, fine hollow particles, or a filler such as sodium chloride is further blended as necessary, thereby forming a porous material. Accordingly, an air bubble portion is compressed with a volume change against various pressure fluctuations. Therefore, it is possible to reduce the deformation in directions other than a compression direction, and to obtain more stable transferability and durability. Examples of the porous rubber material include a porous rubber material having a continuous pore structure in which pores are continuous with each other, and a porous rubber material having an independent pore structure in which pores are independent of each other. In the present invention, any one structure may be used, and these structures may be used in combination.

Further, the transfer body preferably has an elastic layer between the surface layer and the compressive layer. Various materials such as a resin and ceramic can be adequately used as a material of the elastic layer. Various elastomer materials and rubber materials are preferably used in terms of processing properties or the like. Specific examples of the material of the elastic layer include fluorosilicone rubber, phenyl silicone rubber, fluorine rubber, chloroprene rubber, urethane rubber, nitrile rubber, ethylene propylene rubber, natural rubber, styrene rubber, isoprene rubber, butadiene rubber, a copolymer of ethylene/propylene/butadiene, and nitrile butadiene rubber. In particular, silicone rubber, fluorosilicone rubber, and phenyl silicone rubber have small compression set, and thus are preferable in terms of dimensional stability and durability. In addition, these materials have a small change in elastic modulus depending on a temperature, and thus are preferable in terms of transferability. Further, in a case where radiant heat is used in the heating device 110, in order to increase heating efficiency by the radiant heat, it is desirable that a material having a high infrared ray absorption efficiency, such as carbon black, is kneaded in the elastic layer.

Various adhesives or double-faced tapes for fixing and holding the respective layers (the surface layer, the elastic layer, and the compressive layer) constituting the transfer body may be used between the respective layers. In addition, a reinforcement layer having a high compression elastic modulus may be provided in order to suppress lateral extension or to retain an elasticity at the time of mounting the transfer body on the apparatus. In addition, woven fabric may be used as the material of the reinforcement layer. The transfer body can be produced by arbitrarily combining the respective layers formed of the above material.

A size of the transfer body can be freely selected according to a desired print image size. A shape of the transfer body is not particularly limited, and specifically, examples thereof include a sheet shape, a roller shape, a belt shape, and an endless web shape.

In a case where the deterioration is likely to occur due to the action of the acid contained in the reaction liquid under high temperature heating at a portion where the reaction liquid comes into contact with the transfer body or a portion where the reaction liquid is likely to come into contact with the transfer body, or in a case where a material that is likely to be deteriorated is included in the transfer body, a deterioration prevention treatment with the deterioration preventing agent is effective. An example of the material includes a rubber material.

Support Member

The transfer body 101 is supported on the support member 102. Various adhesives or double-faced tapes may be used as a support method of the transfer body. Alternatively, the transfer body may be supported on the support member 102 by using an installation member formed of a metal, ceramic, a resin, or the like and attached to the transfer body.

The support member 102 is required to have a certain degree of structure strength from the viewpoint of conveying accuracy and durability of the transfer body. A metal, ceramic, a resin, and the like are preferably used as a material of the support member. Among them, particularly, aluminum, iron, stainless steel, an acetal resin, an epoxy resin, polyimide, polyethylene, polyethylene terephthalate, nylon, polyurethane, silica ceramic, and alumina ceramic are preferably used as a material of the support member in order to improve control responsiveness by reducing inertia at the time of operation, in addition to increasing of rigidity capable of withstanding a pressure and a dimensional accuracy at the time of transfer. In addition, these materials are preferably used in combination.

Reaction Liquid Applying Device

The reaction liquid applying device 103 includes a reaction liquid receiving unit 103*a* that receives a reaction liquid, and a gravure offset roller including reaction liquid applying members 103*b* and 103*c* that apply the reaction liquid in the reaction liquid receiving unit 103*a* onto the transfer body 101.

Ink Applying Device

The first image is formed by applying the ink from the ink applying device 104 onto the transfer body 101 and mixing the reaction liquid and the ink, and then at least a part of the liquid component is absorbed from the first image by the liquid absorbing device 105.

Liquid Absorbing Device

The liquid absorbing device 105 includes a liquid absorbing member 105*a* and a pressing member 105*b* for liquid absorption that presses the liquid absorbing member 105*a* against the first image on the transfer body 101. By operating the pressing member 105*b* for liquid absorption to press a second surface of the liquid absorbing member 105*a*, a first surface of the liquid absorbing member 105*a* formed of the porous body is brought into contact with the outer circumferential surface of the transfer body 101, such that a nip portion is formed and the first image is allowed to pass the nip portion, whereby the liquid absorption treatment can be performed on the first image. A region which allows the liquid absorbing member 105*a* to be pressed into contact with the outer circumferential surface of the transfer body 101 is used as a liquid absorption treatment region.

A position of the pressing member 105*b* for liquid absorption with respect to the transfer body 101 can be adjusted by a position control mechanism (not illustrated), and for example, the pressing member 105*b* for liquid absorption is configured to be able to reciprocate in the directions of arrow A illustrated in FIG. 1, such that the liquid absorbing member 105*a* can be brought into contact with the outer circumferential surface of the transfer body 101 at the timing when the liquid absorption treatment is required, or can be spaced apart from the outer circumferential surface of the transfer body 101.

It should be noted that shapes of the liquid absorbing member 105*a* and the pressing member 105*b* for liquid absorption are not particularly limited. For example, as illustrated in FIG. 1, it may be configured that the pressing member 105*b* for liquid absorption has a cylindrical shape, the liquid absorbing member 105*a* has a belt shape, and the cylindrical-shaped pressing member 105*b* for liquid absorption presses the belt-shaped liquid absorbing member 105*a* against the transfer body 101. In addition, it may be configured that the pressing member 105*b* for liquid absorption has a cylindrical shape, the liquid absorbing member 105*a* has a cylindrical shape formed on the circumferential surface of the cylindrical-shaped pressing member 105*b* for liquid absorption, and the cylindrical-shaped pressing member 105*b* for liquid absorption presses the cylindrical-shaped liquid absorbing member 105*a* against the transfer body.

The liquid absorbing member 105*a* preferably has a belt shape in consideration of the space in the ink jet recording apparatus.

In addition, the liquid absorbing device 105 including such a belt-shaped liquid absorbing member 105*a* may include a tension member that tensions the liquid absorbing member 105*a*. In FIG. 1, reference numeral 105*c*, 105*d*, and 105*e* denote a tension roller as the tension member. These rollers and the belt-shaped liquid absorbing member 105*a* tensioned by these rollers constitute a conveyance unit that conveys the porous body performing the liquid absorption treatment on the first image. The porous body can be carried in, carried out, and re-transferred to and from the liquid absorption treatment region by the conveyance unit.

In FIG. 1, the pressing member 105*b* for liquid absorption also serves as a roller member that rotates similarly to the tension roller, and the present invention is not limited thereto.

In the liquid absorbing device 105, by pressing the liquid absorbing member 105*a* having the porous body against the first image by the pressing member 105*b* for liquid absorption, the liquid component contained in the first image is absorbed by the liquid absorbing member 105*a*, and the liquid component is thus removed from the first image. In addition to the present method of pressing the liquid absorbing member, as the method of removing the liquid component in the first image, conventionally used various techniques, for example, a heating method, a low humidity air ventilation method, and a decompression method may be used in combination.

Hereinafter, various conditions and a configuration in the liquid absorbing device 105 will be described in detail.

Pretreatment

A deterioration prevention treatment section includes a deterioration preventing agent applying device 111 in a conveyance path of the liquid absorbing member 105*a*.

The deterioration preventing agent applying device 111 applies a deterioration preventing agent onto the porous body before the liquid absorbing member having the porous body comes into contact with the first image.

The porous body of the liquid absorbing member 105*a* is immersed in the deterioration preventing liquid of the deterioration preventing agent applying device 111.

Pressurizing Condition

When the pressure of the porous body pressed against the image on the transfer body is 2.94 N/cm$^2$ (0.3 kgf/cm$^2$) or higher, the solid content and the liquid component in the first image can be separated from each other in a short time, and the liquid component can thus be removed from the first image, which is preferable. In addition, when the pressure is 98.07 N/cm$^2$ (10 kgf/cm$^2$) or lower, a structural load to the apparatus can be reduced, which is preferable. It should be noted that in the present invention, the pressure of the porous body against the first image refers to a nip pressure between the transfer body 101 and the liquid absorbing member 105*a*, and a value of the nip pressure was calculated by performing surface pressure measurement with a surface pressure distribution measuring device (product name:

I-SCAN, manufactured by Nitta Corporation) and dividing a load in a pressurized region by an area. In the process in which the press is started by pressing the porous body holding the deterioration preventing liquid against the transfer body, at least a part of the liquid component and the unreacted reaction liquid contained in the first image on the transfer body is absorbed by the porous body. Further, the deterioration preventing agent is supplied onto the transfer body by the contact with the porous body, and the deterioration prevention treatment can be efficiently performed on the transfer body subjected to the liquid absorbing step.

Action Time

The action time during which the liquid absorbing member 105*a* is brought into contact with the first image is preferable within 50 ms (milliseconds) in order to suppress the adhesion of the coloring material in the first image to the liquid absorbing member. It should be noted that in the present invention, the action time is calculated by dividing a pressure detection width in a moving direction of the transfer body 101 in the above surface pressure measurement by a moving speed of the transfer body 101. Hereinafter, the action time is referred to as a liquid absorbing nip time.

Method of Removing Liquid from Liquid Absorbing Member

The liquid component absorbed from the image by the liquid absorbing member can be removed from the liquid absorbing member 105*a* by a known method. Examples of the method include a heating method, a low humidity air ventilation method, a decompression method, and a porous body squeezing method.

By doing so, the liquid component is absorbed from the first image and the second image with a reduced liquid component is formed on the transfer body 101. Next, the second image is heated in the heating section, and then transferred onto the recording medium 108 in the transfer section. The device configuration and conditions of the heating section and the device configuration and conditions at the time of transfer will be described below.

Heating Device

The second image on the transfer body 101 is heated by the heating device 110 provided in the heating section. By heating the second image, the amount of liquid component remaining in the second image is further reduced, and the film formation with the second image can be accelerated.

Further, in a case where the ink contains the resin component that forms a film by softening or melting by heating, the second image is heated by the heating device 110 and thus is soften, such that adhesiveness of the second image to the recording medium is improved. In this state, for example, the second image is adhered to the recording medium having a low temperature by contact with the recording medium under the temperature equal to or higher than a glass transition temperature of the resin component, such that good transferability can be obtained. Further, the image adhered to the recording medium is solidified and fixed by cooling, and thus the image fastness can be improved.

Any known heating source is applicable to the heating device 110, and a radiant heating source is preferably used because of its good heating efficiency. Various lamps are used as the radiant heating source, and an infrared heater such as a halogen lamp is preferably used because of its high heating efficiency. In addition, in order to further efficiently lead the radiant heat to the transfer body, a reflecting mirror serving as a radiant heat reflecting unit that directs radiant heat from the heating source to the transfer body 101 is preferably used.

The heating device 110 has a plurality of radiant heating sources each having a halogen lamp and a reflecting mirror as a pair that are arranged in a rotation direction of the transfer body 101. The halogen lamp and the reflecting mirror used are manufactured by Fintech Tokyo Co., Ltd. The maximum output of the halogen lamp is $10\times10^3$ W/m, the reflecting mirror used is an aluminum paraboloid mirror having a mirror-polished surface. The paraboloid mirror has a paraboloid cross section having the shortest line connecting the heating source and the transfer body.

The halogen lamp and the reflecting mirror have a length slightly longer than the entire width (the rotation axis direction of the cylindrical-shaped support member 102, that is, the width of the depth direction of the paper surface of FIG. 1) of the transfer body 101, and can heat the entire width of the transfer body 101. A plurality of halogen lamps are connected to a power supply (not illustrated), such that it is possible to individually control radiant fluxes from the respective heating sources by the supply of electric power. The control of the radiant flux from each heating source is performed by a radiant flux controller.

The rotation method of the transfer body is illustrated in the apparatus of FIG. 1, that is, four heating sources are arranged in series from an upstream to a downstream of the moving direction of the transfer body.

The number n of heating sources is not limited to the illustrated example, and the number of heating sources can be plural (n: n>1).

It is preferable that the control of the plurality of heating sources by the radiant flux controller includes a control in which the radiant fluxes from the plurality of heating sources forms a radiant flux row having W1, . . . , and Wn (n>1) sequentially arranged from the upstream of the moving direction of the transfer body, and Relational Expression (1): W1>Wn is satisfied.

The control of the radiant flux is preferable that when a cylindrical-shaped transfer body is used as the transfer body, and the radiant fluxes radiated from the plurality of halogen lamps toward the transfer body are W1, . . . , and Wn sequentially arranged from the upstream of the moving direction of the transfer body, W1>Wn (n>1).

Further, it is preferable that when three or more heating sources are used, these heating sources are controlled so that the radiant fluxes are reduced from W1 to Wn. For example, it is preferable that when three heating sources are used, the three heating sources are controlled so that a relationship of W1>W2>W3 is satisfied. It is preferable that when six heating sources are used, the three heating sources are controlled so that a relationship of W1>W2>W3>W4>W5>W6 is satisfied.

When the transfer body 101 is heated, the reaction liquid containing an acid is applied onto the transfer body, and in some cases, as the maximum reaching temperature of the heating temperature is high and the heating time is long, the surface layer of the transfer body is largely damaged due to the acid. In particular, since the speed of the chemical reaction is exponentially accelerated by the maximum reaching temperature, in order to suppress the damage to the transfer body by the acid, a temperature control for suppressing the surface temperature of the transfer body is very important. Therefore, it is assumed that the heating temperature is rapidly increased and the maximum reaching temperature can be suppressed by the above control.

In the present invention, it is confirmed that there is no problem in the durability of the transfer body when a general heating time by the heating source is hundreds of milliseconds (ms), and the transfer body in a state in which the reaction liquid containing an acid is applied is heated at the temperature of 130° C. or lower.

In addition, the maximum reaching temperature allowable in the durability of the transfer body is also related to the type of acid contained in the reaction liquid, a material and a preparation method of the surface of the transfer body, and durability conditions required for the image forming device, thus the maximum reaching temperature may be set depending on a configuration and conditions to be implemented.

Transfer Device

The transfer section includes a transfer device that transfers an image (ink image) on the transfer body 101 onto the recording medium 108 by pressing the image by the pressing member 106 for transfer against the recording medium conveyed by the recording medium conveyance device 107. After removing the liquid component contained in the image on the transfer body 101 by the liquid absorbing member 105*a*, the image is heated by the heating section and transferred onto the recording medium, such that it is possible to secure film formability and adhesiveness to the recording medium, thereby obtaining the recording image on which curling or cockling is suppressed.

The pressing member 106 for transfer is required to have a certain degree of structure strength from the viewpoint of conveying accuracy and durability of the recording medium. A metal, ceramic, a resin, and the like are preferably used as a material of the pressing member. Among them, particularly, aluminum, iron, stainless steel, an acetal resin, an epoxy resin, polyimide, polyethylene, polyethylene terephthalate, nylon, polyurethane, silica ceramic, and alumina ceramic are preferably used as a material of the support member in order to improve control responsiveness by reducing inertia at the time of operation, in addition to increasing of rigidity capable of withstanding a pressure and a dimensional accuracy at the time of transfer. In addition, these materials may be used in combination.

The time of pressing the image on the transfer body 101 against the recording medium is not particularly limited and is preferably 5 ms or longer and 100 ms or shorter in order to favorably perform the transfer without impairing the durability of the transfer body. The pressing time in the present embodiment refers to a time during which the recording medium 108 and the transfer body 101 are into contact with each other, and is a value calculated by performing surface pressure measurement with a surface pressure distribution measuring device (product name: I-SCAN, manufactured by Nitta Corporation) and dividing a length in the conveyance direction of a pressurized region by a conveyance speed.

In addition, the pressure when the second image on the transfer body 101 is pressed against the recording medium is not particularly limited, and is preferably 9.8 N/cm$^2$ (1 kg/cm$^2$) or higher and 294.2 N/cm$^2$ (30 kg/cm$^2$) or lower in order to favorably perform the transfer without impairing the durability of the transfer body. The pressure in the present embodiment refers to a nip pressure between the recording medium 108 and the transfer body 101, and is a value calculated by performing surface pressure measurement with a surface pressure distribution measuring device and dividing a load in a pressurized region by an area.

The temperature at the time of pressing the recording medium 108 by the pressing member 106 for transfer in order to transfer the second image on the transfer body 101 onto the recording medium 108, is not particularly limited, and in a case where the ink contains a resin component, the temperature is preferably equal to or higher than a glass transition point or a softening point of the resin component contained in the ink. In addition, the apparatus preferably includes the heating device that heats the second image on the transfer body 101, the transfer body 101, and the recording medium 108 at the time of transfer.

An example of a shape of the pressing member 106 for transfer includes, but is not particularly limited to, a roller shape.

Recording Medium and Recording Medium Conveyance Device

In the present embodiment, the type of recording medium 108 is not particularly limited, and any known recording medium can be used. Examples of the recording medium include long materials wound into a roll shape and sheets cut into a predetermined dimension. Examples of the material include a paper, a plastic film, a wooden board, a corrugated cardboard, and a metal film.

In addition, the recording medium conveyance device 107 for conveying the recording medium 108 includes a recording medium feeding roller 107*a* and a recording medium winding roller 107*b*. However, the recording medium conveyance device 107 is not particularly limited thereto as long as it can convey the recording medium.

Control System

Figure 2:
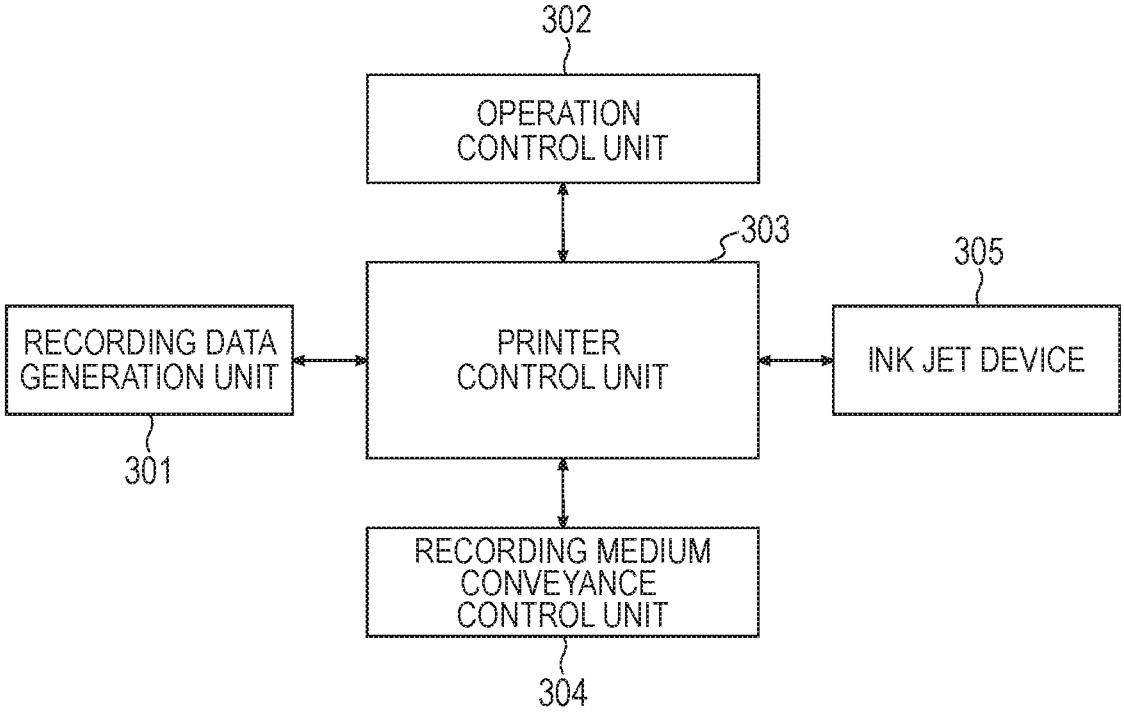
FIG. 2 is a block diagram illustrating a control system for all devices in the ink jet recording apparatus illustrated in FIG. 1.

The transfer type ink jet recording apparatus according to the present embodiment has a control system that controls each device disposed at each section. FIG. 2 is a block diagram illustrating a control system for all devices in the transfer type ink jet recording apparatus illustrated in FIG. 1.

In FIG. 2, reference numeral 301 denotes a recording data generation unit such as an external print server, reference numeral 302 denotes an operation control unit such as an operation panel, reference numeral 303 denotes a printer control unit for executing a recording process, reference numeral 304 denotes a recording medium conveyance control unit for conveying a recording medium, and reference numeral 305 denotes an ink jet device for printing.

Figure 3:
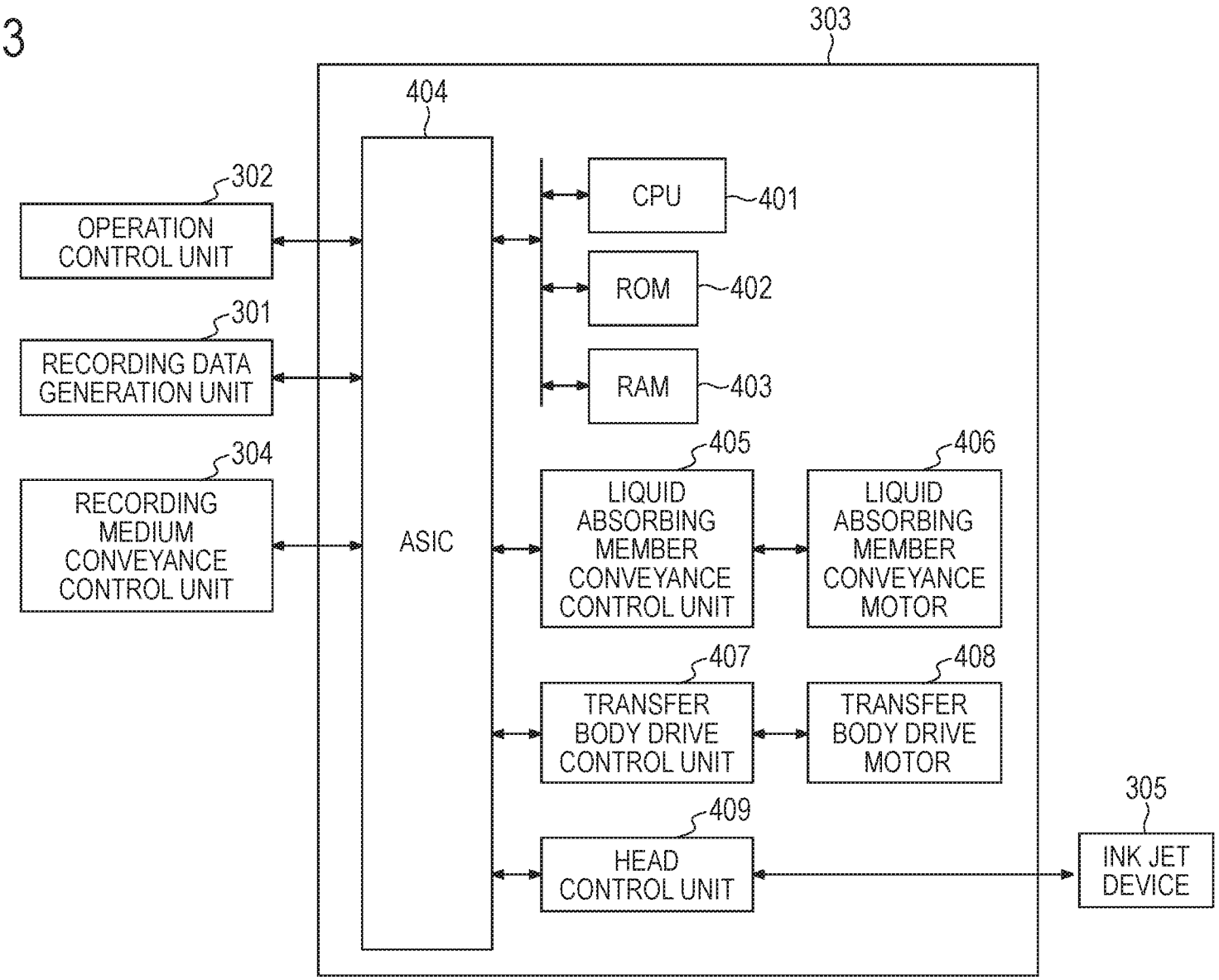
FIG. 3 is a block diagram of a printer control unit in the transfer type ink jet recording apparatus illustrated in FIG. 1.

FIG. 3 is a block diagram of a printer control unit in the transfer type ink jet recording apparatus of FIG. 1.

Reference numeral 401 denotes CPU which controls the whole printer, reference numeral 402 denotes ROM for storing a control program of the CPU, and reference numeral 403 denotes RAM for executing the program. Reference numeral 404 denotes an application specific integrated circuit (ASIC) in which a network controller, a serial IF controller, a controller for head data generation, a motor controller, and the like are embedded. Reference numeral 405 denotes a liquid absorbing member conveyance control unit for driving a liquid absorbing member conveyance motor denoted by reference numeral 406, and the liquid absorbing member conveyance control unit 405 is controlled by a command from the ASIC 404 via serial IF. Reference numeral 407 denotes a transfer body drive control unit for driving a transfer body drive motor denoted by reference numeral 408, and the transfer body drive control unit 407 is also controlled by a command from the ASIC 404 via serial IF. Reference numeral 409 denotes a head control unit that performs the final ejection data generation and drive voltage generation of the ink jet device 305.

The transfer type ink jet recording apparatus according to the present embodiment includes a power supply unit that includes a power supply device having a power supply that supplies power to the heating source of the heating device 110, and a control system that controls the power supply device. The control of the power supply device may be performed by controlling a power supply device control unit by a command from the ASIC illustrated in FIG. 3 via serial IF.

Examples

Hereinafter, the present invention will be described in more detail with reference to Examples and Comparative Examples. The present invention is not limited by the following Examples without departing from the gist of the present invention. Further, in the description of the following Examples, unless otherwise specified, the term "part" is based on mass.

Examples 1 to 4 and Comparative Examples 1 and 2

The transfer type ink jet recording apparatus illustrated in FIG. 1 was used. The transfer body 101 was fixed to the support member 102 using an adhesive.

A sheet obtained by coating a PET sheet having a thickness of 0.5 mm with silicone rubber (KE12, manufactured by Shin-Etsu Chemical Co., Ltd.) at a thickness of 0.3 mm was used as the elastic layer of the transfer body. Further, glycidoxypropyltriethoxysilane and methyltriethoxysilane were mixed at a molar ratio of 1:1, and a mixture of a condensate obtained by heating and refluxing with a photocationic polymerization initiator (SP150, manufactured by ADEKA CORPORATION) was produced. An atmospheric pressure plasma treatment was performed so that a contact angle between a surface of the elastic layer and water was 10 degrees or less. Thereafter, the mixture was applied onto the elastic layer, and a film was formed by UV irradiation (high pressure mercury ramp, integrated light exposure of 5000 mJ/cm$^2$), thermal curing (150° C., for 2 hours), thereby producing the transfer body 101 formed on the elastic layer and having a surface layer of 0.5 μm in thickness.

In this configuration, although illustration is omitted in order to simplify the description, a double-faced tape for holding the transfer body 101 was used between the transfer body 101 and the support member 102.

The reaction liquid applied by the reaction liquid applying device 103 had the following composition, and the application amount thereof was 1 g/m$^2$.

Citric acid: 30.0 parts
Potassium hydroxide: 3.5 parts
Glycerin: 5.0 parts
Surfactant (product name: Megafac F444, manufactured by DIC Corporation): 3.0 parts
Ion-exchange water: residue The ink was prepared as described below.

Preparation of Pigment Dispersion

The 10 parts of carbon black (product name: MONARCH 1100, manufactured by Cabot Corporation), 15 parts of an aqueous resin solution (styrene-ethyl acrylate-acrylic acid copolymer, acid number of 150, weight average molecular weight (Mw) of 8,000, aqueous solution having a resin content of 20.0% by mass was neutralized with an aqueous potassium hydroxide solution), and 75 parts of pure ware were mixed and charged in a batch-type vertical sand mill (manufactured by AIMEX Co., Ltd.), the batch-type vertical sand mill was filled with 200 parts of zirconia beads having a diameter of 0.3 mm, and then a dispersion treatment was performed for 5 hours while being cooled by water. The dispersion liquid was centrifuged to remove coarse particles, thereby obtaining a black pigment dispersion having a pigment content of 10.0% by mass.

Preparation of Resin Particle Dispersion

The 20 parts of ethyl methacrylate and 2 parts of 2,2'-azobis-(2-methylbutyronitrile) were mixed and stirred for 0.5 hours. The mixture was added dropwise into 78 parts of an aqueous solution of 3% by mass NIKKOL BC15 (product name, manufactured by Nikko Chemicals Co., Ltd.) which is a nonionic surfactant, and then stirring was performed for 0.5 hours. Next, the mixture was irradiated with ultrasonic waves by an ultrasonic irradiation device for 3 hours. Subsequently, a polymerization reaction was performed at 80° C. for 4 hours under a nitrogen atmosphere, thereby obtaining a resin particle dispersion having 25% by mass of solid content. The obtained resin particle had a volume average particle diameter of 200 nm. In addition, the obtained resin particle had a glass transition temperature (Tg) of 60° C.

Preparation of Ink

The obtained resin particle dispersion and the pigment dispersion were mixed with the following components. It should be noted that the residue of the ion-exchange water refers to the total amount of all components constituting the ink is 100.0% by mass.

Pigment dispersion (content of coloring material is 10.0% by mass): 40.0% by mass
Resin particle dispersion: 20.0% by mass
Glycerin: 7.0% by mass
Polyethylene glycol (number average molecular weight (Mn): 1,000): 3.0% by mass
Surfactant: Acetylenol E100 (manufactured by Kawaken Fine Chemicals Co., Ltd.): 0.5% by mass
Ion-exchange water: residue After the mixture was sufficiently stirred and dispersed, pressure filtration was performed by a micro filter having a pore diameter of 3.0 μm (manufactured by FUJIFILM Corporation), thereby preparing black ink.

The ink had a minimum filming temperature (MFT) of 100° C.

An ink jet device having the type of ink jet head that ejects ink by an on-demand system using an electrothermal conversion element was used as the ink applying device 104, and the ink application amount was set to 20 g/m$^2$.

The liquid absorbing member 105*a* is adjusted by the tension rollers 105*c*, 105*d*, and 105*e* that convey the liquid absorbing member while tensioning the liquid absorbing member so that the liquid absorbing member moves at a speed equivalent to the moving speed of the transfer body 101. In addition, the recording medium 108 is conveyed by the recording medium feeding roller 107*a* and the recording medium winding roller 107*b* so that the recording medium 108 moves at a speed equivalent to the moving speed of the transfer body 101. The conveyance speed was set to 0.4 m/s, and Aurora coated paper (manufactured by Nippon Paper Industries Co., Ltd., basis weight of 104 g/m$^2$) was used as the recording medium 108.

The deterioration preventing agent applying device 111 applied any one of the following deterioration preventing liquids 1 to 4 to the liquid absorbing member 105*a* at 20 g/m$^2$ by an offset roller method.

Deterioration Preventing Liquid 1

Ion-exchange water

Deterioration Preventing Liquid 2

NaOH aqueous solution

Preparation Method

A 1N-NaOH aqueous solution was added to ion-exchange water and pH thereof was adjusted to 11, thereby obtaining the deterioration preventing liquid 2.

Deterioration Preventing Liquid 3

Phosphate buffer solution

Composition

Sodium dihydrogen phosphate (dihydrate): 3.8% by mass
Sodium dihydrogen phosphate (dodecahydrate): 12.8% by mass
Ion-exchange water: 83.4% by mass Deterioration Preventing Liquid 4

Carbonate buffer solution

Composition

Sodium carbonate: 3.5% by mass
Sodium hydrogen carbonate: 2.8% by mass
Ion-exchange water: 93.7% by mass In addition, a pressure was applied to the liquid absorbing member 105*b* so that an average pressure of the nip pressure between the transfer body 101 and the liquid absorbing member 105*a* becomes 2 kg/cm$^2$. In addition, a roller having a diameter φ of 200 mm was used as the pressing member 105*b* for liquid absorption. A member obtained by laminating HOP60 (product name, manufactured by HIROSE PAPER MFG CO., LTD.) which is polyolefin-based non-woven fabric on the PTFE porous body having an average pore diameter of 0.2 μm was used as the liquid absorbing member 105*a*. The PTFE porous body was obtained by compression-molding of highly crystallized PTFE emulsion polymerized particles and stretching at a temperature equal to or lower than a melting point thereof.

Heating Section

The heating device 110 is configured such that two radiant heating sources each having a halogen lamp and a reflecting mirror as a pair are prepared and arranged in series in the rotation direction of the transfer body 101. The halogen lamp and the reflecting mirror used are manufactured by Fintech Tokyo Co., Ltd. The maximum output of the halogen lamp is 10×10$^3$ W/m, the reflecting mirror used is an aluminum (AL) paraboloid mirror having a mirror-polished surface. The halogen lamp and the reflecting mirror have a length slightly longer than the entire width (width of the depth direction of the paper surface of the drawing) of the transfer body 101, and can heat the entire width of the transfer body 101. The plurality of halogen lamps are connected to a power supply (not illustrated), such that it is possible to supply electric power for each individual halogen lamp.

Heating Temperature Evaluation

In order to evaluate a heating state of the transfer body by the radiant heating source, a ray-tracing simulation for estimating an illuminance distribution of the heating source and a heat conduction simulation for estimating temperature at the time of receiving radiant heating were performed. The ray-tracing simulation was performed by two-dimensional calculation on a cross section with respect to a depth direction of the paper surface of FIG. 1. In consideration of a shape and arrangement of each of the halogen lamp, the reflecting mirror, and the transfer body, a radiant illumination distribution on the transfer body can be calculated by the ray-tracing simulation. In addition, the heat conduction simulation was performed by one-dimensional calculation on a coordinate system of the surface of the rotating transfer body 101 in a thickness direction of the transfer body. By using the result from the ray-tracing simulation, it is possible to estimate a temperature change in a point where the transfer body 101 receiving the radiant heating while rotating is present.

Figure 4:
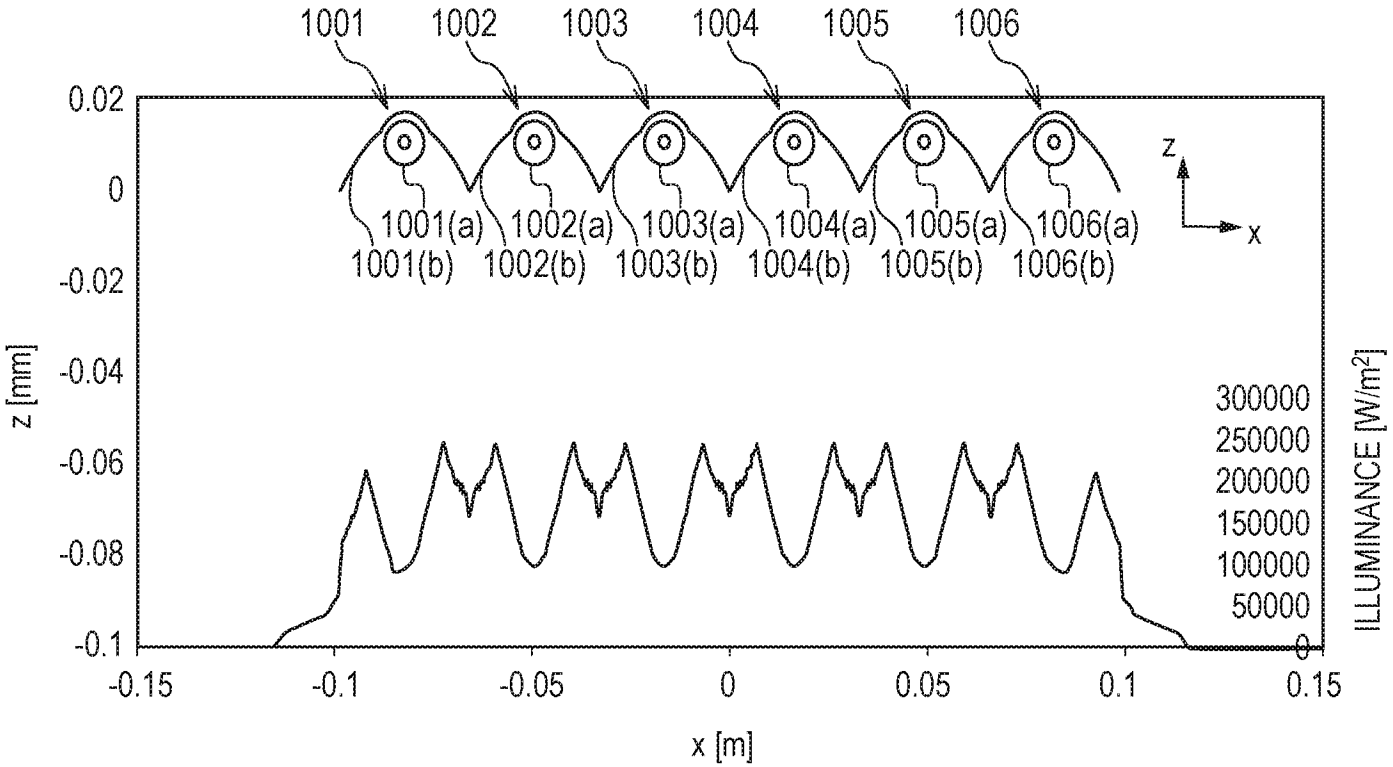
FIG. 4 is a graph illustrating a relationship between a radiant heating source and an illuminance distribution of the radiant heating sources in Examples.

FIG. 4 illustrates the results obtained by calculating an illuminance distribution of six radiant heating sources irradiated to the transfer body 101 by the ray-tracing simulation, and also illustrates a spatial arrangement of the radiant heating sources. In practice, the plurality of radiant heating sources are arranged along the outer circumferential surface of the cylindrical-shaped transfer body 101. However, the plurality of radiant heating sources have a relatively linear relationship in the arrangement, and thus the outer circumferential surface of the transfer body is partially illustrated in FIG. 4 in a linearly developed form. A radiant heating source 1001 is positioned on the upstream of the rotation direction of the transfer body 101, and a radiant heating source 1006 is positioned on the downstream of the rotation direction of the transfer body 101. Six radiant heating sources 1001 to 1006 are combined with halogen lamps 1001(*a*) to 1006(*a*) and reflecting mirrors 1001(*b*) to 1006(*b*), respectively. The illuminance distribution of the drawing is the results of a case where the six halogen lamps are operated at 100% (12×10$^3$ W/m), and the illuminance distributions of one radiant heating source are superimposed.

Heating Condition 1

Figure 5:
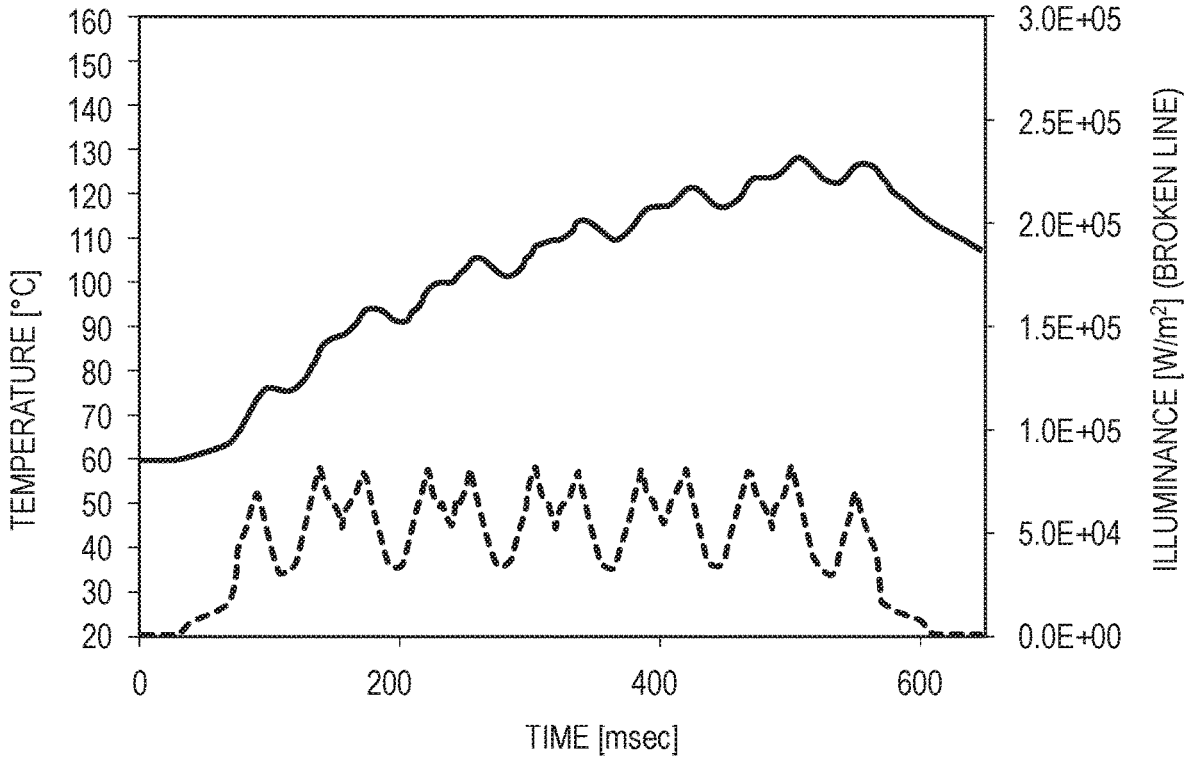
FIG. 5 is a graph illustrating a relationship between a surface temperature of a transfer body and an illuminance distribution of radiant heating sources under a heating condition 1.

FIG. 5 illustrates the results obtained by calculating transition of a surface temperature of the transfer body 101 by the heat conduction simulation using the illuminance distribution calculated as illustrated in FIG. 4. The horizontal axis represents time and the left vertical axis represents a surface temperature of the transfer body 101, and the right vertical axis represents an illuminance of a radiant heating source irradiated to the transfer body 101. In FIG. 5, the solid line represents a change in surface temperature of the transfer body in the same region, and the broken line represents a change in illuminance. In the present heating condition, when proportions (for operation at 100%) of the maximum power chargeable to the halogen lamps 1001(*a*) to 1006(*a*) are R1, R2, R3, R4, R5, and R6, respectively, R1=33%, R2=33%, R3=33%, R4=33%, R5=33%, and R6=33%.

Heating Condition 2

Figure 6:
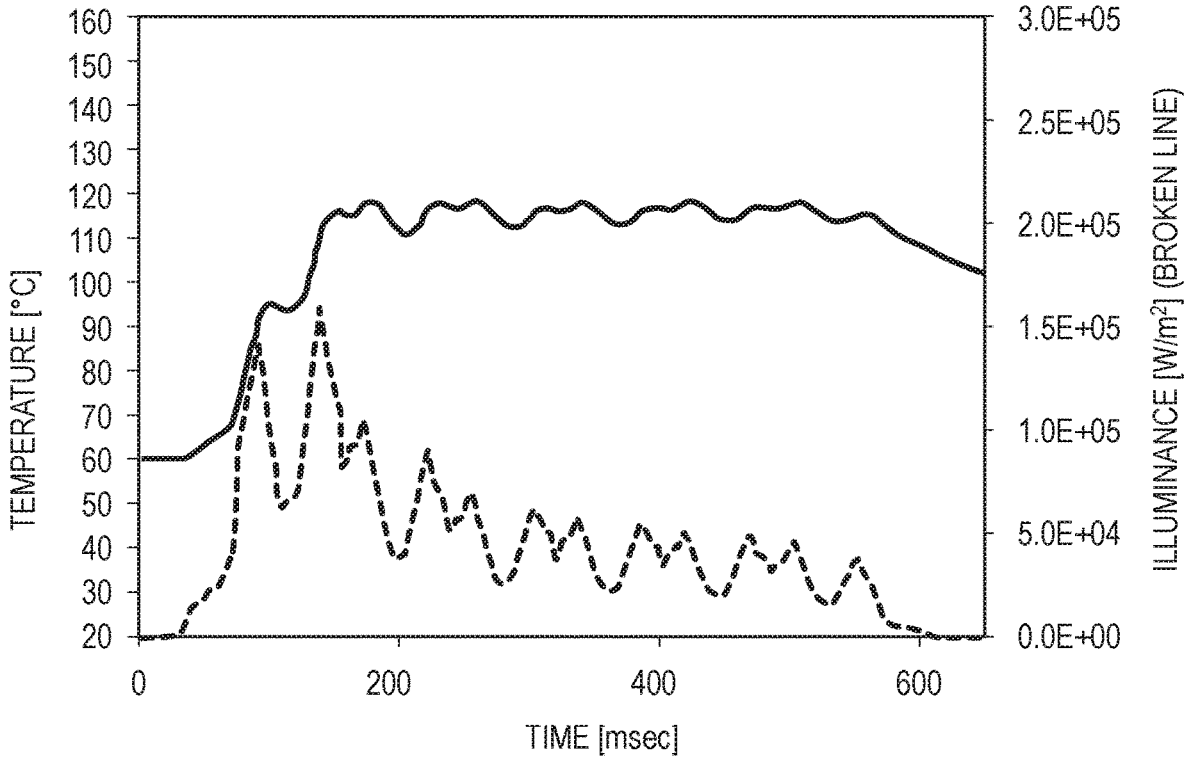
FIG. 6 is a graph illustrating a relationship between a surface temperature of a transfer body and an illuminance distribution of radiant heating sources under a heating condition 2.

FIG. 6 illustrates surface temperature transition calculated by the same method as in FIG. 5 when R1=70.2%, R2=38.4%, R3=26.7%, R4=23.4%, R5=20.9%, and R6=18.4%. In this state, the surface temperature of the transfer body 101 quickly rises up to around 120° C., and then is maintained at a temperature of slightly lower than 120° C.

Experiments were conducted by combinations of the deterioration preventing liquids 1 to 4 and the heating conditions 1 and 2 described above as shown in Table 1.

TABLE 1

| | Deterioration preventing liquid | Heating condition |
|---|---|---|
| Example 1 | Deterioration preventing liquid 1 | Condition 1 |
| Example 2 | Deterioration preventing liquid 2 | Condition 1 |
| Example 3 | Deterioration preventing liquid 3 | Condition 1 |
| Example 4 | Deterioration preventing liquid4 | Condition 1 |
| Example 5 | Deterioration preventing liquid4 | Condition 2 |
| Comparative Example 1 | No treatment of deterioration preventing liquid | Condition 1 |
| Comparative Example 2 | Deterioration preventing liquid 1 | No heating |

Evaluation

The evaluation was performed by the following evaluation method. The evaluation results are shown in Table 2. In the present evaluation, as the evaluation criteria in the following evaluation items, "A" and "B" were set as acceptable levels, and "C" was set as an unacceptable level.

Durability of Transfer Body

Performing of treatment steps in the sections by allowing the image formation surface of the transfer body to pass through the reaction liquid applying section, the ink applying section, the liquid absorbing section, the heating section, the transfer section, and the cleaning section using the transfer type ink jet recording apparatus illustrated in FIG. 1 was defined as one cycle, and the surface of the transfer body after 10000 cycles were operated was observed.

The evaluation criteria are as follows.

A: A scratch or a crack was not observed.

B: A scratch or a crack slightly occurred.

C: Severe scratches or cracks occurred.

Transferability

The quality evaluation of the image obtained by the recording method described above was performed.

A: There was no transfer failure occurred from the transfer body.

B: The image was distorted by a transfer failure occurred from the transfer body.

TABLE 2

| | Durability of transfer body | Transferability |
|---|---|---|
| Example 1 | B | A |
| Example 2 | A | A |
| Example 3 | A | A |
| Example 4 | A | A |
| Example 5 | A | A |
| Comparative Example 1 | C | A |
| Comparative Example 2 | A | B |

According to the present invention, it is possible to provide a transfer type ink jet recording apparatus and a transfer type ink jet recording method that can prevent deterioration of a transfer body by a heating treatment of an image before transfer formed on the transfer body using a reaction liquid containing an acid for increasing a viscosity of ink, and ink.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A transfer type ink jet recording apparatus comprising:

an image forming section including an image forming unit that applies, onto a transfer body, (a) a reaction liquid comprising an acid for increasing a viscosity of ink and (b) ink comprising (i) an aqueous liquid medium, (ii) a resin fine particle, and (iii) a coloring material, to form a first image comprising (i) an aqueous liquid component and (ii) the coloring material;

a liquid absorbing section including a liquid absorbing member comprising a porous body that comes into contact with the first image and that absorbs at least a part of the liquid component from the first image to form a second image;

a heating section including a heating device that heats the second image at a minimum filming temperature or higher of the resin fine particle;

a transfer section that transfers the second image heated by the heating section onto a recording medium; and a deterioration prevention treatment section including a deterioration preventing agent applying device that applies, onto the porous body, a deterioration preventing agent that prevents deterioration of the transfer body, wherein the porous body having been applied with the deterioration preventing agent contacts with a region on the transfer body where the reaction liquid is applied and the ink is not applied, whereby the porous body applies the deterioration preventing agent to the region so as to adjust pH of the region from neutral to alkaline.

2. The transfer type ink jet recording apparatus according to claim 1, wherein the transfer body includes a rubber material.

3. The transfer type ink jet recording apparatus according to claim 1, wherein the deterioration preventing agent includes water, an alkaline solution, or a neutral or alkaline buffer solution.

4. The transfer type ink jet recording apparatus according to claim 1, further comprising a conveyance device that moves the transfer body relative to the image forming section, the liquid absorbing section, the heating section, and the transfer section.

5. The transfer type ink jet recording apparatus according to claim 4, wherein the conveyance device includes a support member having a cylindrical shape and disposes the transfer body on a circumferential surface of the support member to move the transfer body by a rotation of the support member.

6. The transfer type ink jet recording apparatus according to claim 4, wherein the heating device includes a plurality (n: n>1) of radiant heating sources arranged in series in a moving direction of the transfer body, and a radiant flux controller that individually controls radiant fluxes from the respective heating sources, the radiant fluxes being radiated from the plurality of heating sources toward the transfer body, wherein the radiant fluxes from the plurality of heating sources form a radiant flux row having W1, . . . , and Wn sequentially arranged from an upstream of the moving direction of the transfer body, and wherein a control by the radiant flux controller includes a control in which Relational Expression (1): W1>Wn (n>1) is satisfied.

7. The transfer type ink jet recording apparatus according to claim 6, wherein a radiant heat reflecting unit that directs radiant heat from the heating source to the transfer body is provided in each heating source, and wherein the radiant heat reflecting unit has a paraboloid cross section having a shortest line connecting the heating source and the transfer body.

8. The transfer type ink jet recording apparatus according to claim 6, wherein the radiant flux controller includes a power supply unit that individually controls power supplied to the plurality of heating sources.

9. The transfer type ink jet recording apparatus according to claim 1, wherein the heating device heats the transfer body having been applied with the reaction liquid at 130° C. or lower.

10. The transfer type ink jet recording apparatus according to claim 1, wherein the minimum filming temperature of the resin fine particle is 100° C. or higher.

11. A transfer type ink jet recording method comprising:

an image forming step of applying, onto a transfer body, (a) a reaction liquid comprising an acid for increasing a viscosity of ink and (b) ink comprising (i) an aqueous liquid medium, (ii) a resin fine particle, and (iii) a coloring material, to form a first image comprising (i) an aqueous liquid component and (ii) the coloring material;

a liquid absorbing step of bringing a porous body of a liquid absorbing member into contact with the first image and absorbing at least a part of the liquid component from the first image to form a second image;

a heating step of heating the second image at a minimum filming temperature or higher of the resin fine particle;

a transfer step of transferring the second image heated in the heating step onto a recording medium; and a deterioration preventing agent applying step of applying, onto the porous body, a deterioration preventing agent that prevents deterioration of the transfer body, wherein the porous body having been applied with the deterioration preventing agent contacts with a region on the transfer body where the reaction liquid is applied and the ink is not applied, whereby the porous body applies the deterioration preventing agent to the region so as to adjust pH of the region from neutral to alkaline.

12. The transfer type ink jet recording method according to claim 11, wherein the transfer body includes a rubber material.

13. The transfer type ink jet recording method according to claim 11, wherein the deterioration preventing agent includes water, an alkaline solution, or a neutral or alkaline buffer solution.

14. The transfer type ink jet recording method according to claim 11, wherein an image forming section performing the image forming step, a liquid absorbing section performing the liquid absorbing step, a heating section performing the heating step, and a transfer section performing the transfer step are provided in a transfer type ink jet recording apparatus to perform the respective steps by moving the transfer body relative to the respective sections.

15. The transfer type ink jet recording method according to claim 14, wherein the transfer body is disposed on a circumferential surface of a support member to move the transfer body by a rotation of the support member.

16. The transfer type ink jet recording method according to claim 14, wherein the heating section includes a heating device, wherein the heating device includes a plurality (n: n>1) of radiant heating sources arranged in series in a moving direction of the transfer body, and a radiant flux controller that individually controls radiant fluxes from the respective heating sources, the radiant fluxes being radiated from the plurality of heating sources toward the transfer body, wherein the radiant fluxes from the plurality of heating sources form a radiant flux row having W1, . . . , and Wn sequentially arranged from an upstream of the moving direction of the transfer body, and wherein a control by the radiant flux controller includes a control in which Relational Expression (1): W1>Wn (n>1) is satisfied.

17. The transfer type ink jet recording method according to claim 16, wherein a radiant heat reflecting unit that directs radiant heat from the heating source to the transfer body is provided in each heating source, and wherein the reflecting unit has a paraboloid cross section having a shortest line connecting the heating source and the transfer body.

18. The transfer type ink jet recording method according to claim 16, wherein the radiant flux controller includes a power supply unit that individually controls power supplied to the plurality of heating sources.

19. The transfer type ink jet recording method according to claim 11, wherein the heating device heats the transfer body having been applied with the reaction liquid at 130° C. or lower.

20. The transfer type ink jet recording method according to claim 11, wherein the minimum filming temperature of the resin fine particle is 100° C. or higher.

21. A transfer type ink jet recording apparatus comprising:

an image forming section including an image forming unit that applies, onto a transfer body, (a) a reaction liquid comprising an acid for increasing a viscosity of ink and (b) ink comprising (i) an aqueous liquid medium, (ii) a resin fine particle, and (iii) a coloring material, to form a first image comprising (i) an aqueous liquid component and iii) the coloring material;

a liquid absorbing section including a liquid absorbing member comprising a porous body that condenses the ink forming the image by (a) coming into contact with the first image and (b) absorbing at least a part of the liquid component from the first image to form a second image;

a heating section including a heating device that heats the second image at a minimum filming temperature or higher of the resin fine particle;

a transfer section that transfers the second image heated by the heating section onto a recording medium; and a deterioration prevention treatment section including a deterioration preventing agent applying device that applies, onto the porous body, a deterioration preventing agent that prevents deterioration of the transfer body, wherein the porous body having been applied with the deterioration preventing agent contacts with a region on the transfer body where the reaction liquid is applied and the ink is not applied, whereby the porous body applies the deterioration preventing agent to the region so as to adjust pH of the region from neutral to alkaline.

* * * * *